US005538089A

United States Patent [19]

Sanford

[11] Patent Number: 5,538,089

[45] Date of Patent: Jul. 23, 1996

[54] POWER TOOL CLUTCH ASSEMBLY

[75] Inventor: Christopher P. Sanford, Abingdon, Md.

[73] Assignee: The Black & Decker Corporation, Towson, Md.

[21] Appl. No.: 462,026

[22] Filed: Jun. 5, 1995

[51] Int. Cl.[6] ..... B25B 23/14; B25B 21/00

[52] U.S. Cl. ..... 173/2; 173/13; 173/216; 173/178; 192/34; 192/48.1; 192/54.5; 192/89.21; 192/139

[58] Field of Search ..... 173/2, 13, 176, 173/178, 213, 216; 192/150, 34, 48.1, 54.5, 56.61, 69.8, 89.21, 139; 81/467, 473, 475

[56] References Cited

U.S. PATENT DOCUMENTS

| | | | |
|---|---|---|---|
| 1,744,976 | 1/1930 | Levedahl . | |
| 2,724,299 | 11/1953 | Amtsberg | 81/52.4 |
| 2,884,103 | 4/1959 | Connell | 192/56 |
| 2,927,672 | 3/1960 | Banner | 192/56 |
| 2,968,979 | 1/1961 | Aijala | 81/52.4 |
| 3,398,611 | 8/1968 | Hahner | 81/52.4 |
| 3,807,539 | 4/1974 | Reed | 192/150 |
| 4,606,443 | 8/1986 | Kimura | 192/20 |
| 4,655,103 | 4/1987 | Schreiber et al. | 192/150 X |
| 4,809,572 | 3/1989 | Sasaki | 81/429 |
| 4,947,714 | 8/1990 | Fluri | 81/475 |
| 5,060,733 | 10/1991 | Kress | 173/178 |
| 5,138,916 | 8/1992 | Sato et al. | 81/474 |
| 5,209,308 | 5/1993 | Sasaki | 173/178 |
| 5,350,026 | 9/1994 | Markus et al. | 173/178 |
| 5,372,206 | 12/1994 | Sasaki et al. | 173/178 |

FOREIGN PATENT DOCUMENTS

| | | |
|---|---|---|
| 437803 | 11/1926 | Germany . |
| 2501189 | 7/1975 | Germany . |
| 3432382A1 | 3/1986 | Germany . |
| 51-15280 | 1/1973 | Japan . |

*Primary Examiner*—Scott A. Smith
*Assistant Examiner*—Jay A. Stelacone
*Attorney, Agent, or Firm*—Finnegan, Henderson, Farabow, Garrett & Dunner

[57] ABSTRACT

A power tool clutch assembly is provided. A first spindle is configured to rotate in a gear case. A drive clutch element is fixed to the first spindle. A second spindle rotates independently of the first spindle. An output clutch element is fixed to the second spindle. An intermediate clutch element is positioned between the drive and output clutch elements, rotatable and slidable relative to the second spindle. A compression spring is provided between the intermediate and output clutch elements. A clutch housing supports the clutch components. The clutch housing and clutch components all can be removed from a power tool gear casing for easy service.

11 Claims, 5 Drawing Sheets

POWER TOOL CLUTCH ASSEMBLY

BACKGROUND OF THE INVENTION

FIELD OF THE INVENTION

The present invention relates to a power tool for driving a fastener. More particularly, it relates to a power tool clutch assembly, and a clutch and housing assembly attachable to a gear case of a power tool.

DESCRIPTION OF THE RELATED ART

Power tools used to drive fasteners into work surfaces such as wood, drywall and concrete are well known. A number of conventional power tools are designed today with a depth-sensitive clutch assembly.

Conventional depth-sensitive clutch assemblies have several common parts. Conventional assemblies typically have at least one spindle driven by an output gear. Conventional assemblies may have three clutch elements, including a drive clutch element, an intermediate clutch element, and an output clutch element, with the drive clutch element being an integral part of the gear. All three conventional clutch elements have engaging surfaces of varying configurations in order for the clutch elements to engage one another. Many of these conventional engaging surfaces are perpendicular to the face of the clutch element. Conventional assemblies typically have a spring positioned between the drive clutch element and the intermediate clutch element. Conventional assemblies typically have a depth cone, locator, or bit stop surrounding a bit tip holder. Finally, conventional assemblies have a clutch housing open to the gear case.

The conventional clutch assembly described above operates as follows. When the screwdriver bit is applied to a head of a fastener, the operator supplies a force which causes the output clutch element and intermediate clutch element to compress together, simultaneously compressing the spring until the intermediate clutch element and gear/drive clutch element contact one another. The motor acts through a pinion to rotate the gear/drive clutch element, which because of the engagement of the engaging surfaces, rotates the intermediate clutch element. The opposing engaging surfaces enable the intermediate clutch element to rotate the output clutch element which in turn rotates the drive shaft. When the fastener is nearly driven home, the bit stop contacts the work surface, thereby absorbing the operator-applied force. The removal of the operator-applied force to the bit enables the spring to begin biasing the gear/drive clutch element and intermediate clutch element apart, with resultant disengagement of their respective engaging surfaces. By the time the fastener is snugged home, the gear and intermediate clutch element are driven completely out of engagement with one another.

The conventional clutch assemblies have a number of shortcomings.

The engagement surfaces that are perpendicular to the faces of their respective clutch elements constitute "point loads." These "point loads" bear a great deal of stress during clutch operation. The perpendicular surfaces wear excessively and occasionally break off.

The position of the spring between the intermediate clutch element and the drive clutch element also has disadvantages. When the clutch elements disengage, the shaft, the intermediate clutch element, and the output clutch element all continue to spin. Spinning this amount of mass results in a "heavy" feel to the tool, which operators do not prefer.

Maintenance is difficult on these conventional clutch assemblies. Service of the clutch involves removal of the gear, involving invasion of the gear casing.

The conventional clutch assembly also is open to the gear casing, so debris and dust caused by wear of the gears enters the clutch housing and impacts the clutch components. This problem, combined with the maintenance problem discussed above, increases the frequency and expense of servicing the tool.

Another disadvantage relates to operating the power tool in reverse, e.g., to back a screw out of the workpiece. This operation requires resetting of the bit stop. Furthermore, in order to engage the clutch, operator force must be applied against the screw while attempting to back the screw out, which is undesirable to many operators.

SUMMARY OF THE INVENTION

The present invention has been made in view of the above circumstances and provides a depth-sensitive clutch which experiences less stress at its engagement surfaces.

A further advantage of the present invention is that the depth-sensitive clutch can be serviced easily, inexpensively, and less frequently.

Another advantage of the present invention is that the clutch and housing assembly can be removed and replaced easily.

Additional advantages of the invention will be set forth in the description which follows and in part will be obvious from the description, or may be learned by practice of the invention. The advantages of the invention may be realized and attained by means of the combinations particularly pointed out in the appended claims.

In accordance with the purposes of the invention, as embodied and described herein, the power tool clutch assembly of the present invention comprises a first spindle defining an axis and configured to be rotatable in a gear case. An annular drive clutch element is fixed to the first spindle and rotatable therewith, the drive clutch element having a first cam surface. A second spindle coaxially aligns with the first spindle and is configured to be rotatable in a clutch housing. An annular output clutch element is fixed to the second spindle and rotatable therewith, the output clutch element having a second cam surface. An annular intermediate clutch element is positioned on the second spindle to be rotatable and axially slidable relative to the second spindle intermediate the output clutch element, having a third cam surface engageable with the first cam surface of the drive clutch element, and a fourth cam surface engageable with the second cam surface of the output clutch element. A spring is positioned along the second spindle between the output clutch element and the intermediate clutch element.

The present invention further comprises a power tool clutch and housing assembly, including the clutch assembly described above in combination with a clutch housing, having first and second ends, the first end attachable to a power tool gear case, and a depth cone attachable relative to the second end of the clutch housing.

The power tool clutch assembly also can include a bearing coaxially mounted on the second spindle between the spindle and the intermediate clutch element. The bearing is configured to allow the intermediate clutch element to rotate independently of the second spindle when the second spindle rotates in one direction, and to fix the intermediate clutch element to rotate with second spindle when it rotates in an opposite direction.

DESCRIPTION OF THE DRAWINGS

The accompanying drawings, which are incorporated in and constitute a part of this specification, illustrate embodiments of the invention and, together with the description, serve to explain the objects, advantages, and principles of the invention. In the drawings.

DESCRIPTION OF THE PREFERRED EMBODIMENTS

Reference will now be made in detail to the present preferred embodiments of the invention as broadly illustrated in the accompanying drawings.

Figure 1:
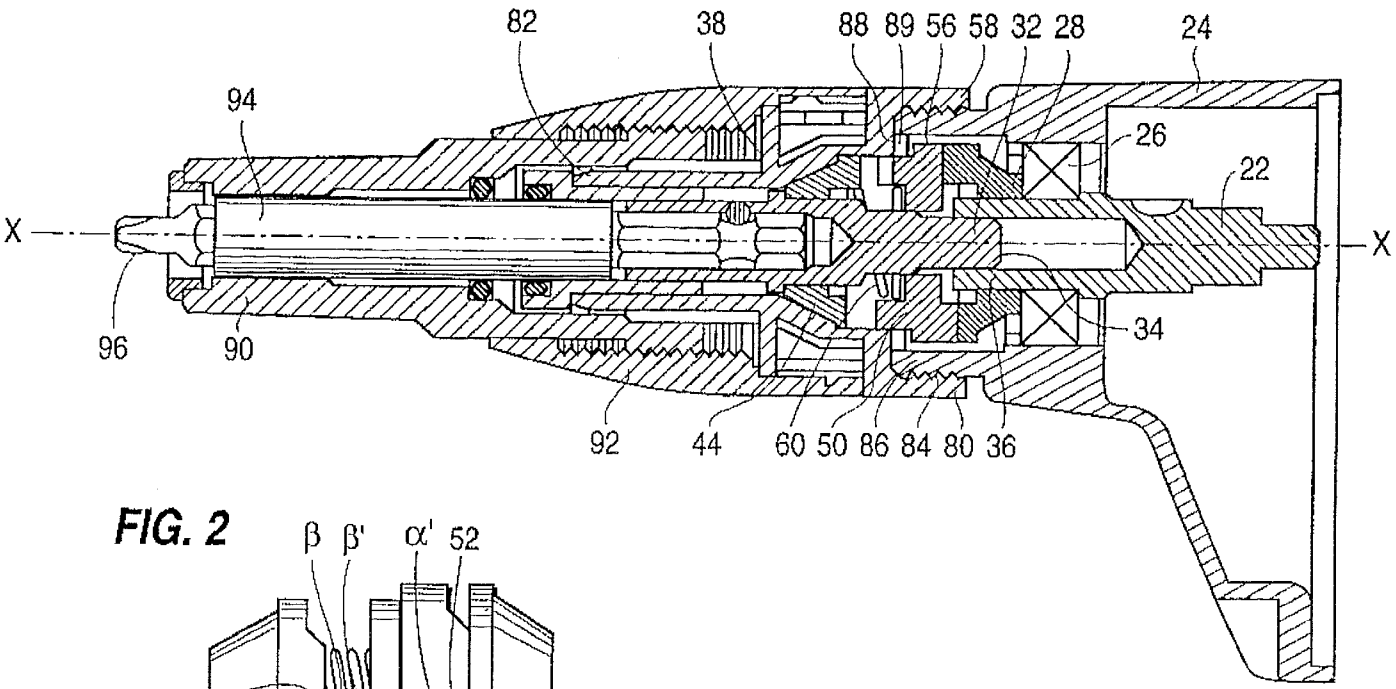
FIG. 1 is a cross-sectional view of a power tool clutch and housing assembly in accordance with the invention.

In accordance with the invention, a power tool clutch assembly includes a first spindle defining an axis and configured to be rotatable in a gear case. As embodied herein, and as shown in FIG. 1, first spindle or output spindle 22 is positioned along axis x—x. Output spindle 22 is driven by an output gear (not shown) and configured to rotate within gear casing 24. Output spindle 22 is supported by annular bearing 26 positioned between the output spindle 22 and the gear casing.

In accordance with the invention, an annular drive clutch element is fixed to the first spindle and rotatable therewith, the drive clutch element having a first cam surface. As embodied herein, annular drive clutch element 28 is fixed proximate a distal end of output spindle 22, so that as spindle 22 rotates, drive clutch element 28 rotates in unison. Drive clutch element 28 preferably is manufactured of steel or powder metal alloy.

Figure 2:
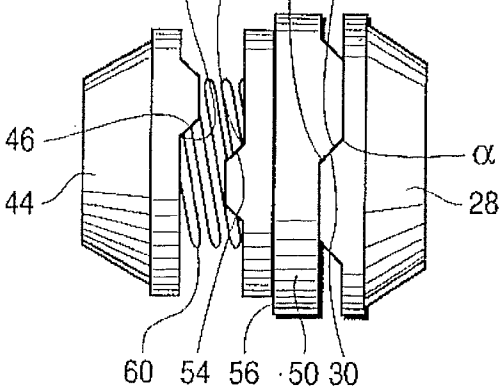
FIG. 2 is a side view of the clutch elements depicted in FIG. 1.

As depicted in FIG. 2, drive clutch element 28 includes first cam surface 30. First cam surface 30 is configured with a slope $\alpha$ with respect to the face of the clutch element. Slope $\alpha$ preferably is approximately 45° plus or minus 2°. It is further preferred that at least three first cam surfaces 30 be provided, spaced 120° apart on the annular drive clutch element 28.

In accordance with the invention, a second spindle is coaxially aligned with the first spindle, configured to be rotatable in a clutch housing. As embodied herein, a second spindle or clutch spindle 32 is provided along axis x—x having a distal end 34 supported by end 36 of the output spindle 22. Clutch spindle 32 is configured to be rotatable within a clutch housing 38. Clutch spindle 32 rotates independently of output spindle 22.

In accordance with the invention, an annular output clutch element is fixed to the second spindle and rotatable therewith, the output clutch element having a second cam surface. As embodied herein, annular output clutch element 44 is fixed to a position along clutch spindle 32 intermediate its two ends so that as clutch spindle 32 rotates, output clutch element 44 rotates in unison. Output clutch element 44 preferably is manufactured of steel or powder metal alloy.

As depicted in FIG. 2, output clutch element 44 includes second cam surface 46. Second cam surface 46 is configured with a slope $\beta$ with respect to the face of the clutch element. Slope $\beta$ preferably is approximately 20° plus or minus 2°. It is further preferred that at least three second cam surfaces 46 be provided, spaced 120° apart on the annular output clutch element 44. Preferably, slope $\alpha$ is greater than slope $\beta$.

In accordance with the invention, an annular intermediate clutch element is positioned on the second spindle to be rotatable and axially slidable relative to the second spindle intermediate the output clutch element and drive clutch elements, and has a third cam surface engageable with the first cam surface of the drive clutch element, plus a fourth cam surface engageable with the second cam surface of the output clutch element. As embodied herein, annular intermediate clutch element 50 is positioned on clutch spindle 32, but not fixed to the spindle. Instead, intermediate clutch element 50 is free to rotate relative to clutch spindle 32, and to slide relative to clutch spindle 32 along axis x—x. Intermediate clutch element 50 is positioned on the clutch spindle so that it is between fixed output clutch element 44, and drive clutch element 28 fixed to output spindle 22. Intermediate clutch element 50 preferably is manufactured of steel or powder metal alloy.

As depicted in FIG. 2, intermediate clutch element 50 has two opposing faces, each face having cam surfaces. The face opposing drive clutch element 28 has third cam surface 52. Third cam surface 52 has a slope $\alpha'$ that matches slope $\alpha$ of first cam surface 30, preferably 45°±2° relative to the respective face of intermediate clutch element 50. The number of third cam surfaces 52 also matches the number of first cam surfaces 30, preferably three, spaced 120° apart. Third cam surface 52 hence is engageable with first cam surface 30. Moreover, the face of intermediate clutch element 50 opposing output clutch element 44 has fourth cam surface 54. Fourth cam surface 54 has a slope $\beta'$ that matches slope $\beta$ of second cam surface 46, preferably 20°±2° relative to the respective face of intermediate clutch element 50. The number of fourth cam surfaces 54 also matches the number of second cam surface 46, preferably three, spaced 120° apart. Fourth cam surface 54 hence is engageable with second cam surface 46.

It also is preferred that intermediate clutch element 50 be configured with an annular projecting shoulder 56 on the side of the clutch element facing the output clutch element 44 and facing away from drive clutch element 28. The purpose of shoulder 56 will be explained in more detail below.

In accordance with the invention, a spring is positioned along the second spindle between the output clutch element and the intermediate clutch element. As embodied herein, a spring 60 is provided around clutch spindle 32 between output clutch element 44 and intermediate clutch element 50 in order to bias these two clutch elements apart.

In one embodiment of the invention, the clutch assembly also is provided with a bearing coaxially mounted on the second spindle between the second spindle and the intermediate clutch element, the bearing configured to allow the intermediate clutch element to rotate independently of the second spindle when the second spindle rotates in one direction, and to fix the intermediate clutch element to rotate with the second spindle when the second spindle rotates in an opposite direction. As embodied in FIG. 3, a one-way bearing 70 is provided to fit snugly between intermediate clutch element 50 and clutch spindle 32, and is pressed into the intermediate clutch element. One of ordinary skill in the art will recognize that a one-way bearing typically comprises an annular cylindrical casing with a series of rollers spaced about its inner periphery, the rollers placed on a ramped surface so that they rotate freely in one-direction, but lockup and cannot rotate in the other direction. When a one-way bearing 70 is provided between intermediate clutch element 50 and clutch spindle 32, intermediate clutch element 50 will rotate independently of and relative to clutch spindle 32 only in one direction. However, if a torque is applied to rotate intermediate clutch element 50 in the other direction, the one-way bearing 70 will lock intermediate clutch element 50 to clutch spindle 32 and force them to rotate in unison. The purpose of providing this one-way bearing with certain embodiments of the invention will be described in more detail below.

The components of the invention described above are related to the clutch assembly aspect of the invention. The manufacture of a power tool clutch assembly having the components described above is a practice of one aspect of the invention. Another aspect of the invention, however, relates to a power tool clutch and housing assembly, which can be attached to or removed from the gear casing of a power tool.

Figure 3:
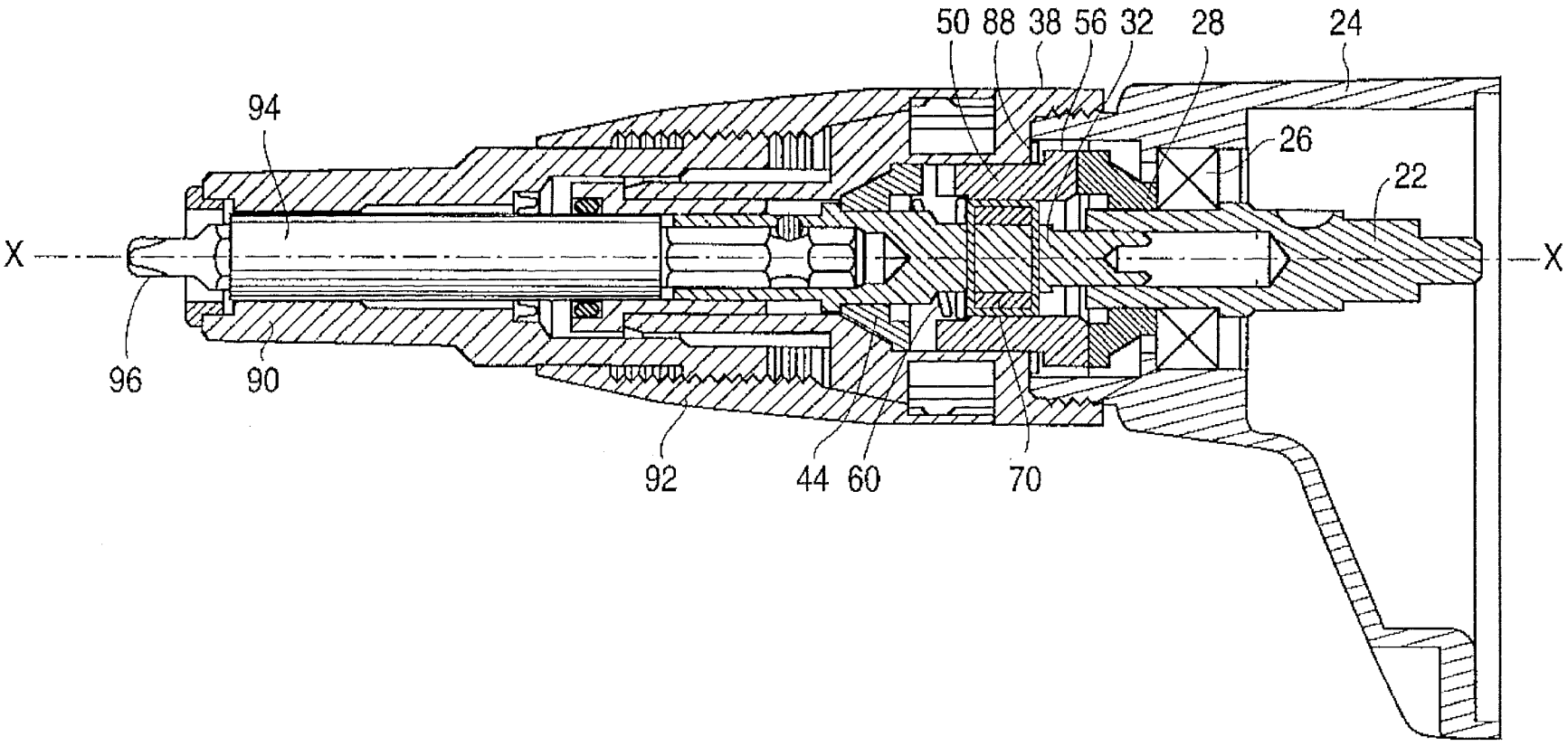
FIG. 3 is a cross-sectional view of the power tool clutch and housing assembly in accordance with the invention, further including a one-way bearing.

In accordance with the invention, the power tool clutch and housing assembly includes a clutch housing having first and second ends, the first end attachable to a power tool gear case. As embodied herein, and as shown in FIGS. 1 and 3, clutch housing 38 includes a first end 80 facing gear case 24, and a second end 82 facing the operating end of the tool.

Preferably, clutch housing 38 is made of a suitable metal, and is configured to attach to gear casing 24 at first end 80 by the engagement of threads 84 on the clutch housing and threads 86 on the gear casing. Hence, clutch housing 38 can be attached to and removed from gear casing 24 relatively easily for maintenance and/or replacement. Moreover, as depicted in FIGS. 1 and 3, the outer diameter of clutch housing 38 matches that of gear casing 24 for a clean fit.

It is further preferred that clutch housing 38 be configured with an annular projecting shoulder 88 on its inner surface at a position opposing projecting shoulder 56 on intermediate clutch element 50. A journal bearing 89 should be provided on shoulder 88.

In accordance with the invention, the clutch and housing assembly further includes a depth cone attachable relative to the second end of the clutch housing. As shown in FIGS. 1 and 3, a depth cone (also known as a locator or bit stop) 90 attaches to clutch housing 38 via an adjusting collar 92. A bit tip holder 94 rotates within depth cone 90 along axis x—x, communicating with clutch spindle 32. Bit tip holder 94 is configured to have a selected bit tip 96 attached thereto.

In accordance with the invention, the clutch and housing assembly further includes the clutch assembly components described above, including the output spindle, fixed drive clutch element with cam surface, clutch spindle, fixed output clutch element with cam surfaces, intermediate clutch element with cam surfaces, and spring intermediate the output and intermediate clutch elements. In another embodiment, a one-way bearing can be provided between the intermediate clutch element and clutch spindle, as described above.

When the invention is provided as a power tool clutch and housing assembly, the entire clutch and housing assembly can be removed from the gear casing for service of the clutch. All clutch components are completely separate from the rest of the tool. Even the output shaft and drive clutch are completely separate from the gear, making disassembly and service easier, less time-consuming, and less expensive.

Another advantage is that bearing 26, in addition to supporting output spindle 22, acts to seal off the gear casing and clutch components from debris and wear particles coming from or going into the gear case.

The invention has been described relative to a power tool clutch assembly, and a power tool clutch and housing assembly. However, one may choose to manufacture an entire power tool, including a gear casing, gearing, motor, and so forth, which includes either the clutch assembly or the clutch and housing assembly described above. It is to be understood that a power tool having the clutch assembly components or the clutch and housing assembly components described above also falls within the scope of the invention.

Operation of the invention will now be described. This description also will illustrate certain aspects and advantages associated with the present invention.

Figure 4:
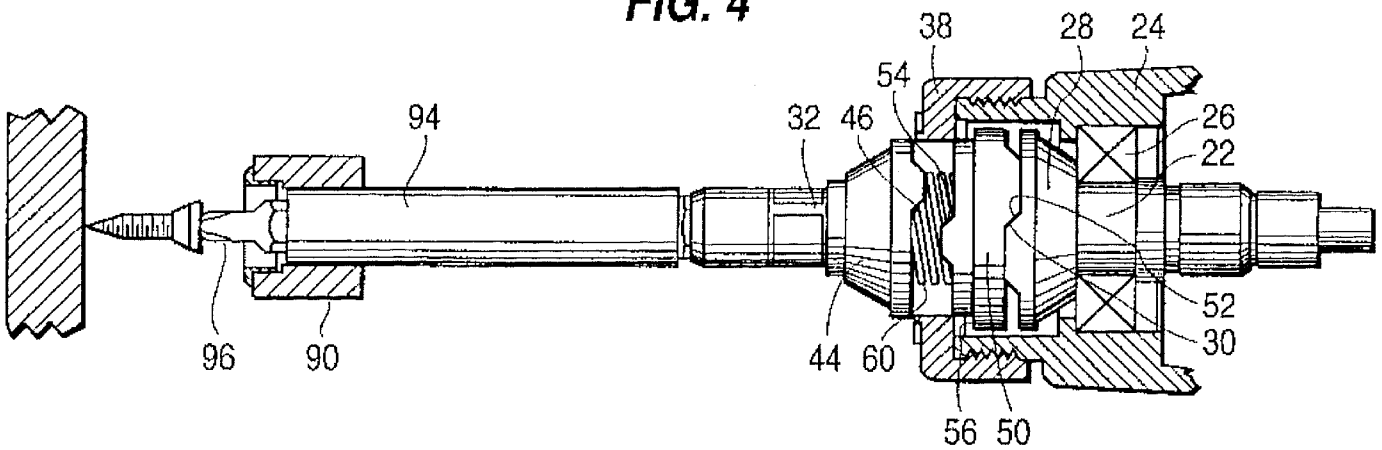
FIG. 4. is a side view of a power tool clutch assembly and related components depicting operation when no bias force is applied to an output spindle.

When an operator is ready to drive a screw into a work surface, the operator first sets depth cone or locator 90 to the desired depth, and engages the screw with bit 96. The position of the clutch assembly component at this time is shown in FIG. 4.

Figure 5:
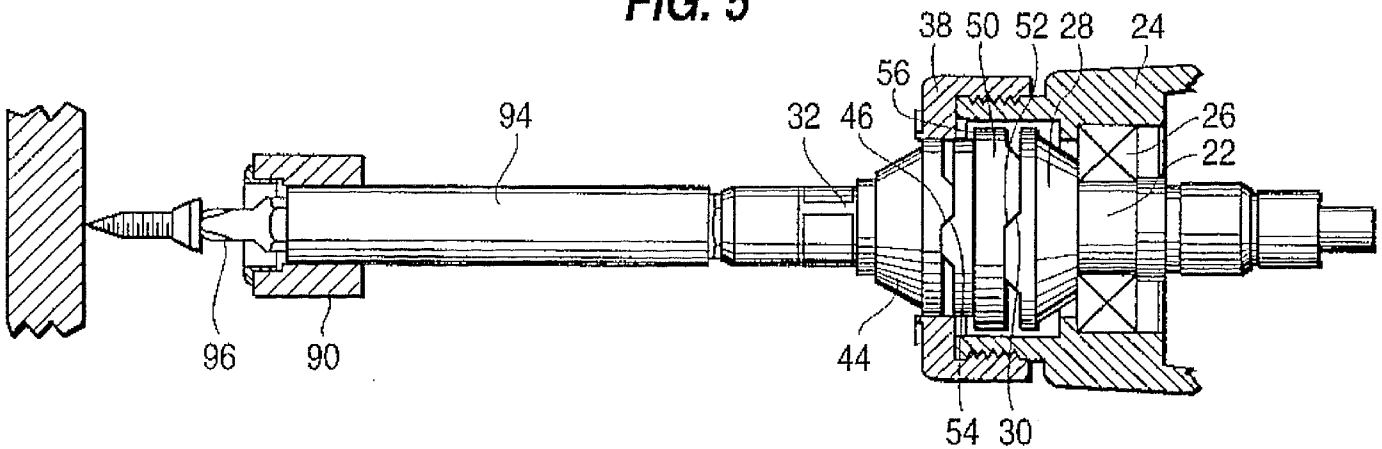
FIG. 5 is a side view similar to FIG. 4, depicting the power tool clutch assembly when bias first is applied by pushing against a screw, and the clutch engages.

Next, and as shown in FIG. 5, the operator applies a downward force on the tool. This operator-applied force pushes bit tip holder 94, clutch spindle 32, and output clutch element 44 back against the spring 60. As spring 60 is compressed, output clutch element 44 is pushed against intermediate clutch element 50, which in turn is pushed against drive clutch element 28.

Figure 6:
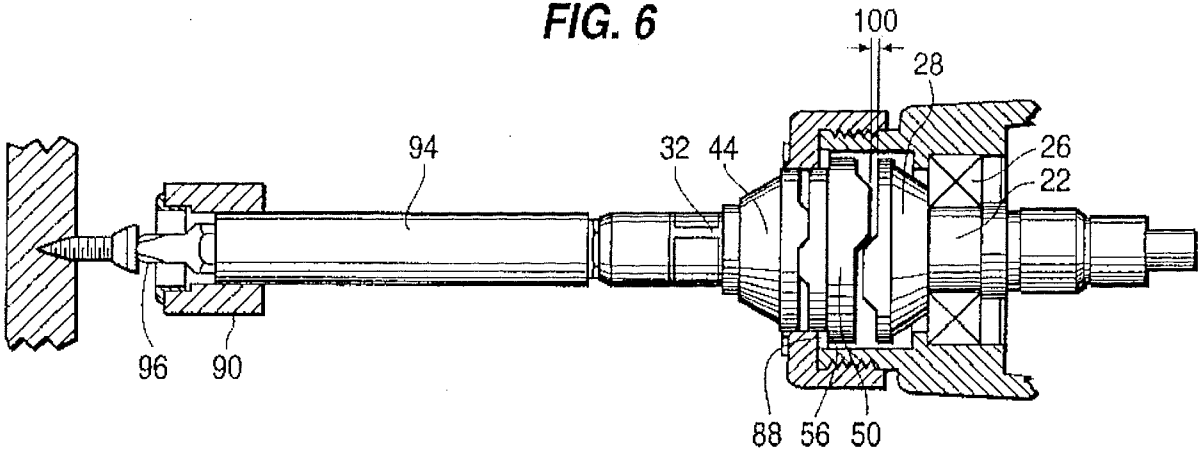
FIG. 6 is a side view similar to FIG. 5, with bias applied and the clutch engaged, and the screw being driven.

As shown in FIG. 6, power is applied to the tool. The gear (not shown) rotates output spindle 22 and drive clutch element 28. First and third cam surfaces 30 and 52, respectively, engage one another, so that torque is applied to intermediate clutch element 50. Likewise, second and fourth cam surfaces 46 and 54, respectively, engage one another, so that torque is applied to output clutch element 44. Because output clutch element 44 is fixed to clutch spindle 32, the clutch spindle also rotates, thereby rotating bit tip holder 94 and bit 96 and driving the screw.

It also can be seen from FIG. 6 that, because of the slope $\alpha$ of first and third cam surfaces 30 and 52, intermediate clutch element 50 will tend to slide axially away from drive clutch element 28. This axial movement of intermediate clutch element 50 away from drive clutch element 28 is interrupted, however, by the engagement of annular projecting shoulder 56 on intermediate clutch element 50, with corresponding annular shoulder 88 on clutch housing 38. The axial distance travelled by intermediate clutch element 50 establishes a small clearance 100.

Figure 7:
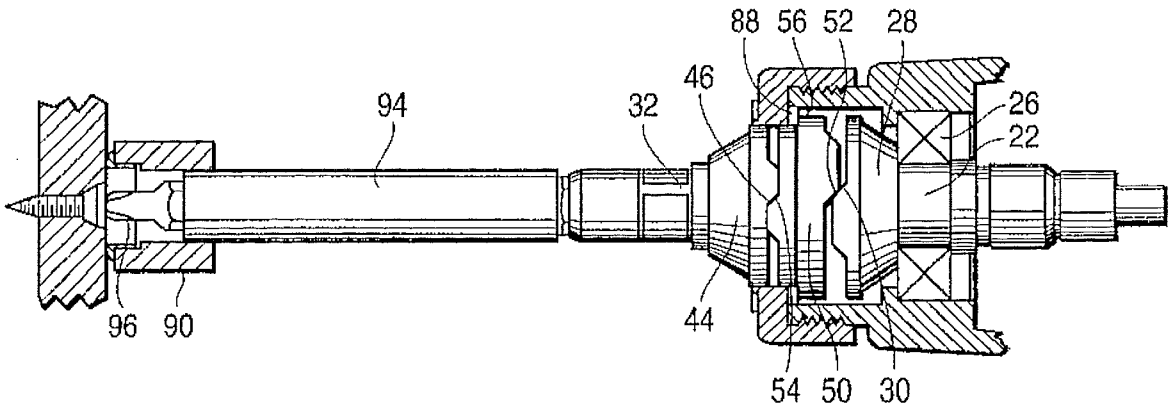
FIG. 7 is a side view similar to FIG. 6, with the screw driven flush to the work piece and the bit stop taking up the operator-applied force.

In FIG. 7, the screw eventually is driven flush to the work piece surface. The user-applied force now is taken up by the depth cone 90 instead of the bit 96. Hence, the bias force of spring 60 is free to begin reasserting itself.

Figure 8:
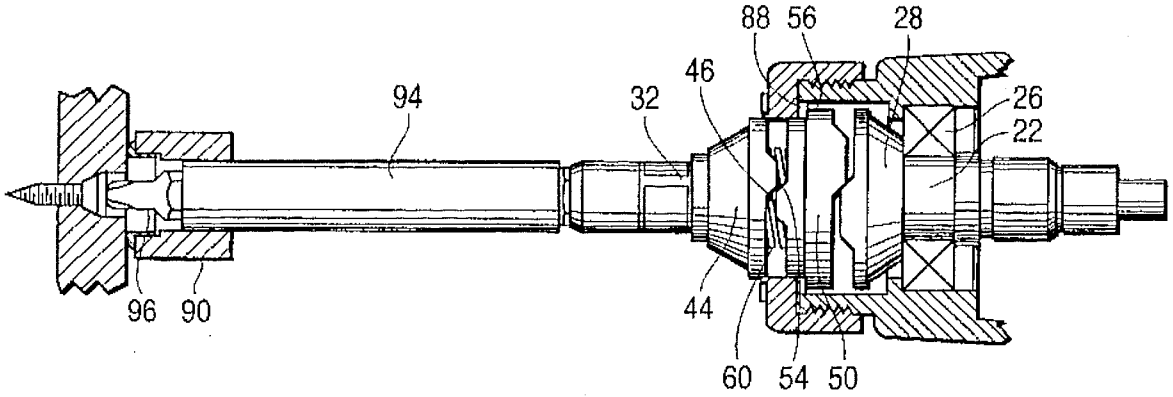
FIG. 8 is a side view similar to FIG. 7, with the screw being snugged home and the spring biasing apart the output and intermediate clutch elements.

As shown in FIG. 8, complete seating of the spring and removal of the user-applied force allow clutch spindle 32 to travel axially forward, partially assisted by the bias of spring 60 against output clutch element 44. Eventually, output clutch element 44 and intermediate clutch element 50 disengage, removing the torque from the output clutch element 44 and clutch spindle 32.

Figure 9:
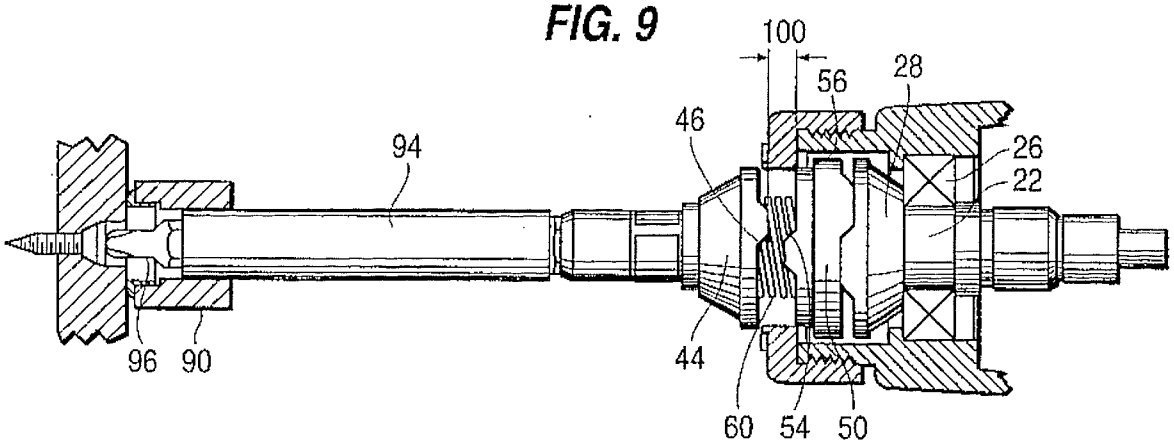
FIG. 9 is a side view similar to FIG. 8 with the output and intermediate clutch elements driven completely apart by the spring.

As shown in FIG. 9, spring 60 pushes intermediate clutch element 50 deeper into engagement with drive clutch element 28, transferring clearance 100 to the other side of intermediate clutch element 50 in order to prevent unwanted cam surface re-engagement of clutch elements 44 and 50. This prevents clutch "chattering," making the clutch a "quiet" clutch.

From the above description of the operation of the invention, one of ordinary skill will recognize additional advantages of the features of the invention. First, the use of sloped cam surfaces on the face of each of the three clutch elements provides full surface planar contact between the engaging surfaces of each clutch element, with resultant distributed stress, rather than focused point-loaded stress experienced by engaging surfaces that are perpendicular to the face of the clutch element. Because point-loads are avoided, there is less wear of the engaging surfaces. Also, the problem of perpendicular point-loaded surfaces chipping or breaking off is eliminated.

The skilled artisan further will recognize that sloped cam surfaces can be used on all of the clutch element faces because a stop is provided in the form of engaging annular shoulders 56 and 88 on the intermediate clutch element and clutch housing, respectively. Hence the clutch housing 38 plays a dual role, both housing the clutch assembly, and stopping the axial movement of intermediate clutch element 50. Further, the stress applied between shoulders 56 and 88 is applied in the axial direction, and is not nearly as great as the point-loaded force applied to engaging surfaces arranged perpendicular to the direction of the applied torque in conventional clutches.

The skilled artisan also will recognize the advantage of relocating compression spring 60 to a position between the intermediate clutch element 50 and output clutch element 44. Once the clutch becomes disengaged, only the clutch spindle 32 and the output clutch element 44 spin. In contrast, when the spring is positioned between the drive clutch element and the intermediate clutch element as in conventional clutches, then the intermediate clutch element also spins after the clutch disengages. The invention, therefore, spins less weight after clutch disengagement, providing a lighter feel to the clutch.

An additional advantage is obtained by the embodiment of the invention employing a one-way bearing 70, as depicted broadly in FIG. 3. In the FIG. 3 embodiment, the clutch assembly operates as described above in the forward direction, i.e., when the tool is used to drive a screw into a work piece. However, the clutch depicted in FIG. 3 will work differently in the reverse direction, i.e., when the tool is used to back a screw out of the work piece. When the tool is engaged in reverse, output spindle 22 and drive clutch element 28 rotate in the reverse direction. Engagement of drive clutch element 28 and intermediate clutch element 50 rotates intermediate clutch element 50 in the reverse direction. Because of the one-way bearing 70, however, intermediate clutch element 50 no longer rotates independently of clutch spindle 32. Instead, intermediate clutch element 50 also rotates a clutch spindle 32, bit tip holder 94, and bit 96 in the reverse direction. In other words, when the one-way bearing 70 is provided, clutch spindle 32 operates as a "dead" spindle in the forward direction, and a "live" spindle in the reverse direction. For this reason, the operator can back out a screw without having to reset the position of depth cone 90 or remove the depth cone, and without having to apply a force to the screw to engage his clutch while trying to back out the screw.

The foregoing description of preferred embodiments of the invention has been presented for purposes of illustration and description. It is not intended to be exhaustive or to limit the invention to the precise form disclosed. Modifications and variations are possible in light of the above teachings or may be acquired from practice of the invention. The embodiments were chosen and described in order to explain the principles of the invention and the practical application to enable one skilled in the art to utilize the invention in various embodiments and with various modification as are suited to the particular use contemplated. It is intended that the scope of the invention be defined by the claims and their equivalents.

I claim:

1. A power tool clutch assembly comprising:

a first spindle defining an axis and configured to be rotatable in a gear case;

an annular drive clutch element fixed to said first spindle and rotatable therewith, said drive clutch element having a first cam surface defining an angle with respect to the axis greater than 0° and less than 90°;

a second spindle coaxially aligned with said first spindle and configured to be rotatable in a clutch housing and movable along the axis between an engaged position and a disengaged position;

an annular output clutch element fixed to said second spindle and rotatable therewith, said output clutch element having a second cam surface defining an angle with respect to the axis greater than 0° and less than 90°;

an annular intermediate clutch element positioned on the second spindle to be rotatable and axially slidable relative to the second spindle intermediate said output clutch element and drive clutch element, having a third cam surface defining an angle with respect to the axis greater than 0° and less than 90° engageable with the first cam surface of the drive clutch element, a fourth cam surface defining an angle with respect to the axis greater than 0° and less than 90° engageable with the second cam surface of the output clutch element, and a shoulder projecting therefrom generally transverse to the axis and intermediate the third and fourth cam surfaces, configured to be engageable with a corresponding shoulder projecting from the clutch housing; and a spring positioned along the second spindle between the output clutch element and the intermediate clutch element;

wherein said first, second, third, and fourth cam surfaces are configured to engage when said second spindle is in said engaged position, said first and third cam surfaces further being configured to slide relative to one another upon application of a torque to the drive clutch element until said intermediate clutch element shoulder engages the clutch housing shoulder, and said output clutch element is fixed to said second spindle in a position that is spaced axially from the clutch housing shoulder when said second spindle moves to the disengaged position.

2. A power tool clutch assembly according to claim 1, wherein said first and third cam surfaces have a first slope with respect to the axis, and said second and fourth cam surfaces have a second slope with respect to the axis, said first slope being greater than said second slope.

3. A power tool clutch assembly according to claim 1, further comprising a bearing coaxially mounted on said second spindle between said second spindle and said intermediate clutch element, said bearing configured to allow said intermediate clutch element to rotate independently of said second spindle when said second spindle rotates in one direction, and to fix said intermediate clutch element to rotate with the second spindle when the second spindle rotates in an opposite direction.

4. A power tool clutch and housing assembly comprising:

a clutch housing having first and second ends, the first end attachable to a power tool gear case;

a depth cone attachable relative to the second end of the clutch housing;

a first spindle defining an axis projecting from the first end of the housing and configured to be rotatable in the gear case;

an annular drive clutch element fixed to said first spindle and rotatable therewith, said first clutch element having a first cam surface defining an angle with respect to the axis greater than 0° and less than 90°;

a second spindle coaxially aligned with said first spindle and rotatable in the clutch housing and movable along the axis between an engaged position and a disengaged position;

an annular output clutch element fixed to said second spindle and rotatable therewith, said output clutch element having a second cam surface defining an angle with respect to the axis greater than 0° and less than 90°;

an annular intermediate clutch element positioned on the second spindle to be rotatable and axially slidable relative to the second spindle intermediate said output clutch element and drive clutch element, having a third cam surface defining an angle with respect to the axis greater than 0° and less than 90° engageable with the first cam surface of the drive clutch element, a fourth cam surface defining an angle with respect to the axis greater than 0° and less than 90° engageable with the second cam surface of the output clutch element, and a shoulder projecting therefrom generally transverse to the axis and intermediate the third and fourth cam surfaces, configured to be engageable with a corresponding shoulder projecting from the clutch housing;

a spring positioned along the second spindle between the output clutch element and the intermediate clutch element; and a bit tip holder coaxially aligned and rotatable with the second spindle and slidable and rotatable relative to the depth cone;

wherein said first, second, third, and fourth cam surfaces are configured to engage when said second spindle is in said engaged position, said first and third cam surfaces further being configured to slide relative to one another upon application of a torque to the drive clutch element until said intermediate clutch element shoulder engages the clutch housing shoulder, and said output clutch element is fixed to said second spindle in a position that is spaced axially from the clutch housing shoulder when said second spindle moves to the disengaged position.

5. A power tool clutch element and housing assembly according to claim 4, wherein said first and third cam surfaces have a first slope with respect to the axis, and said second and fourth cam surfaces have a second slope with respect to the axis, said first slope being greater than said second slope.

6. A power tool clutch element and housing assembly according to claim 4, further comprising a bearing coaxially mounted on said second spindle between said second spindle and said intermediate clutch element, said bearing configured to allow said intermediate clutch element to rotate independently of said second spindle when said second spindle rotates in one direction, and to fix said intermediate clutch element to rotate with the second spindle when the second spindle rotates in an opposite direction.

7. A power tool clutch element and housing assembly according to claim 5, further comprising a bearing coaxially surrounding said first spindle and sealing the clutch and housing assembly from the gear case.

8. A power tool comprising:

a gear case;

a clutch housing having first and second ends, the first end attachable to the gear case;

a depth cone attachable relative to the second end of the clutch housing;

a first spindle defining an axis projecting from the first end of the housing and rotatable in the gear case;

an annular drive clutch element fixed to said first spindle and rotatable therewith, said first clutch element having a first cam surface defining an angle with respect to the axis greater than 0° and less than 90°;

a second spindle coaxially aligned with said first spindle and rotatable in the clutch housing and movable along the axis between an engaged position and a disengaged position;

an annular output clutch element fixed to said second spindle and rotatable therewith, said output clutch element having a second cam surface defining an angle with respect to the axis greater than 0° and less than 90°;

an annular intermediate clutch element positioned on the second spindle to be rotatable and axially slidable relative to the second spindle intermediate said output clutch element and drive clutch element, having a third cam surface defining an angle with respect to the axis greater than 0° and less than 90° engageable with the first cam surface of the drive clutch element, a fourth cam surface defining an angle with respect to the axis greater than 0° and less than 90° engageable with the second cam surface of the output clutch element, and a shoulder projecting therefrom generally transverse to the axis and intermediate the third and fourth cam surfaces, configured to be engageable with a corresponding shoulder projecting from the clutch housing;

a spring positioned along the second spindle between the output clutch element and the intermediate clutch element; and a bit tip holder coaxially aligned and rotatable with the second spindle and slidable and rotatable relative to the depth cone;

wherein said first, second, third, and fourth cam surfaces are configured to engage when said second spindle is in said engaged position, said first and third cam surfaces further being configured to slide relative to one another upon application of a torque to the drive clutch element until said intermediate clutch element shoulder engages the clutch housing shoulder, and said output clutch element is fixed to said second spindle in a position that is Spaced axially from the clutch housing shoulder when said second spindle moves to the disengaged position.

9. A power tool according to claim 8, wherein said first and third cam surfaces have a first slope with respect to the axis, and said second and fourth cam surfaces have a second slope with respect to the axis, said first slope being greater than said second slope.

10. A power tool according to claim 8, further comprising a bearing coaxially mounted on said second spindle between said second spindle and said intermediate clutch element, said bearing configured to allow said intermediate clutch element to rotate independently of said second spindle when said second spindle rotates in one direction, and to fix said intermediate clutch element to rotate with the second spindle when the second spindle rotates in an opposite direction.

11. A power tool according to claim 8, further comprising a bearing coaxially surrounding said first spindle and sealing the clutch housing from the gear case.

* * * * *

UNITED STATES PATENT AND TRADEMARK OFFICE

CERTIFICATE OF CORRECTION

PATENT NO. : 5,538,089

DATED : July 23, 1996

INVENTOR(S) : Christopher P. Sanford

It is certified that error appears in the above-indentified patent and that said Letters Patent is hereby corrected as shown below:

Claim 7, column 10, line 22, change "claim 5" to read

--claim 4--.

Claim 8, column 11, line 9, change "Spaced" to read

--spaced--.

Signed and Sealed this

Twenty-second Day of October, 1996

*Attest:*

*Attesting Officer*

BRUCE LEHMAN

*Commissioner of Patents and Trademarks*